US008485487B2

(12) United States Patent
Cheng

(10) Patent No.: US 8,485,487 B2
(45) Date of Patent: Jul. 16, 2013

(54) EASY-MOUNT IN-CEILING SPEAKER MOUNT

(76) Inventor: Liang-Chih Cheng, New Taipei (TW)

( * ) Notice: Subject to any disclaimer, the term of this patent is extended or adjusted under 35 U.S.C. 154(b) by 264 days.

(21) Appl. No.: 13/110,492

(22) Filed: May 18, 2011

(65) Prior Publication Data

US 2012/0292458 A1 Nov. 22, 2012

(51) Int. Cl.
*B42F 13/00* (2006.01)

(52) U.S. Cl.
USPC ..... 248/343; 248/201; 248/317; 381/386; 381/395

(58) Field of Classification Search
USPC ..... 248/343, 287.1, 906, 314, 201, 317; 362/382, 404, 364, 365; 381/332, 335, 386, 381/387, 423, 432, 433; 181/171, 172
See application file for complete search history.

(56) References Cited

U.S. PATENT DOCUMENTS

| | | | | |
|---|---|---|---|---|
| 4,484,658 | A * | 11/1984 | Grote | 381/395 |
| 4,673,149 | A * | 6/1987 | Grote et al. | 248/343 |
| 5,133,018 | A * | 7/1992 | Miyazaki | 381/395 |
| 5,206,464 | A * | 4/1993 | Lamm et al. | 181/150 |
| 5,221,069 | A * | 6/1993 | Struthers et al. | 248/231.9 |
| 5,734,732 | A * | 3/1998 | Lemmon | 381/386 |
| 6,870,943 | B2 * | 3/2005 | Liu | 381/395 |
| 6,925,190 | B2 * | 8/2005 | Popken et al. | 381/395 |
| 7,325,648 | B2 * | 2/2008 | Sasaki et al. | 181/150 |
| 7,334,767 | B2 * | 2/2008 | Wright | 248/342 |
| 7,401,681 | B2 * | 7/2008 | Iwayama et al. | 181/150 |
| 7,515,728 | B2 * | 4/2009 | Kobayashi et al. | 381/398 |
| 7,570,778 | B2 * | 8/2009 | Wright | 381/387 |
| 7,587,059 | B2 * | 9/2009 | Wright | 381/387 |
| 7,676,045 | B2 * | 3/2010 | Merrey et al. | 381/87 |
| 7,780,135 | B2 * | 8/2010 | Nelson et al. | 248/342 |
| 8,023,664 | B2 * | 9/2011 | Yang | 381/87 |
| 8,090,140 | B2 * | 1/2012 | Suzuki et al. | 381/423 |
| 8,103,034 | B2 * | 1/2012 | Tai | 381/332 |
| 8,110,951 | B2 * | 2/2012 | Huang | 310/25 |
| 8,131,004 | B2 * | 3/2012 | Horigome et al. | 381/409 |
| 8,223,987 | B2 * | 7/2012 | Shibata et al. | 381/87 |
| 8,224,014 | B2 * | 7/2012 | Sprinkle | 381/386 |
| 8,256,728 | B2 * | 9/2012 | Wright | 248/221.11 |
| 8,290,201 | B2 * | 10/2012 | Kamimura et al. | 381/423 |
| 8,311,262 | B2 * | 11/2012 | Kulchy et al. | 381/394 |

(Continued)

FOREIGN PATENT DOCUMENTS

TW M338520 8/2008

*Primary Examiner* — Terrell McKinnon
*Assistant Examiner* — Monica Millner
(74) *Attorney, Agent, or Firm* — C. G. Merserau; Nikolai & Merserau, P.A.

(57) ABSTRACT

An easy-mount in-ceiling speaker mount has multiple fastening units mounted on an in-ceiling speaker. Each fastening unit has a base frame, a torsion spring securely mounted on the base frame, a pivoting member pivotally mounted on the base frame, a slider plate longitudinally movable on the base frame, and a spring holder receiving the torsion spring, pivotally mounted on the base frame and blocked by the pivoting member. When the speaker mount is moved upwardly through a ceiling, a bottom of the ceiling holds a ceiling support formed on the slider plate and the pivoting member is pushed and pivoted. After being unblocked from the pivoting member, the spring holder is pivoted to hold a top of the ceiling in completion of the mounting of the speaker mount. Accordingly, the mounting procedures of the speaker mount can be easily achieved by simply pushing it upwardly through a ceiling.

4 Claims, 6 Drawing Sheets

U.S. PATENT DOCUMENTS 8,369,559 B2 * 2/2013 Liang et al. ..... 381/386
8,382,341 B2 * 2/2013 Peter ..... 362/370
2004/0125974 A1 * 7/2004 Kosatos et al. ..... 381/335
2007/0121988 A1 * 5/2007 Merrey et al. ..... 381/386

* cited by examiner

EASY-MOUNT IN-CEILING SPEAKER MOUNT

BACKGROUND OF THE INVENTION

1. Field of the Invention

The present invention relates to an in-ceiling speaker mount, and more particularly to an easy-mount in-ceiling speaker mount capable of holding an in-ceiling speaker on a ceiling when the in-ceiling speaker is mounted upwardly in a mounting hole of the ceiling.

2. Description of the Related Art

General buildings are built to have a paging and voice alarm system having a plurality of speakers mounted in each floor and partition for paging and emergency announcement. Conventionally, an in-ceiling speaker can be mounted in a mounting hole formed through a ceiling for the purposes of saving space and improving aesthetic appearance.

With reference to FIG. 6, a conventional in-ceiling speaker mount has an annular wall 80, multiple elastic holders 90 and a speaker hood 100. The annular wall 80 has an annular flange 81 formed on and protruding radially from a bottom of the annular wall 80. The elastic holders 90 are mounted on the annular flange 81, and each elastic holder 90 has a torsion spring 92 and a spring holder 91. The spring holder 91 has a hood 912 formed on and protruding from a top of the spring holder 91 for retaining a movable end 922 of the torsion spring 92 in the hood 912. The speaker hood 100 is securely mounted through the annular wall 80 and has a lower opening 120. An in-ceiling speaker is mounted in the speaker hood 100 through the lower opening 120.

The conventional in-ceiling speaker and mounts can be mounted as follows. The annular wall 80 is inserted into a mounting hole of a ceiling until the annular flange 81 abuts against a bottom of the ceiling. Meanwhile, the elastic holders 90 are located above the ceiling. The movable end of each torsion spring 92 can be unlocked from a corresponding hook 912 by being accessed through the annular wall 80 and automatically springs back to abut against and press the ceiling due to a torque of the torsion spring 92. The speaker hood 100 is securely and upwardly mounted through the annular wall 80. The in-ceiling speaker is securely mounted in the speaker hood 100 through the lower opening 120.

The foregoing mounting procedures are inconvenient and time consuming. Besides, each in-ceiling speaker mount has two separate parts, namely, the annular wall 80 and the speaker hood 100, which consume more material to implement.

SUMMARY OF THE INVENTION

An objective of the present invention is to provide an easy-mount in-ceiling speaker mount capable of fastening an in-ceiling speaker on a ceiling when the in-ceiling speaker is mounted upwardly in a mounting hole of the ceiling.

To achieve the foregoing objective, the easy-mount in-ceiling speaker mount has multiple fastening units adapted to be mounted on a top of an in-ceiling speaker. Each fastening unit has a base frame, a torsion spring, a pivoting member, a slider plate and a spring holder.

The base frame has a narrow bottom and a wide top. The narrow bottom has two parallel walls respectively formed on and protruding forwardly from two opposite sides of the narrow bottom. Each parallel wall has multiple through holes longitudinally formed through the parallel wall and respectively aligning with the through holes of the other parallel wall. The wide top has a pivot base and two slider guides. The pivot base is formed on and protrudes forwardly from the front of the wide top. The slider guides are mounted on a portion of the wide top protruding beyond the narrow bottom in the longitudinal direction.

The torsion spring is securely mounted between the parallel walls by selectively mounting a pin through two corresponding through holes of the parallel walls and the torsion spring, and has a free end and a fixed end. The fixed end abuts against a front of the narrow bottom.

The pivoting member has a pivot body, a fixing element and a contact rod. The pivot body is pivotally mounted on the pivot base of the base frame and has two ends opposite to each other. The fixing element is mounted in one of the ends of the pivot body. The contact rod is mounted on the other end of the pivot body.

A slider plate has a sliding slot, a tag and a ceiling support. The sliding slot is longitudinally formed through the slider plate for the slider guides to be mounted within the sliding slot and longitudinally movable relative to the sliding slot. The tag is formed on and protrudes from a top of the slider plate toward the pivoting member, and is located above the contact rod of the pivoting member. The ceiling support is formed on and protrudes forwardly from a bottom of the slider plate.

The spring holder is pivotally mounted between the parallel walls of the base frame by penetrating the pin through a bottom of the spring holder and the torsion spring, and has a front wall and a rear flange. The front wall abuts against the free end of the torsion spring subjected to a preset torque. The rear flange is formed on and protrudes transversely from a rear edge of the sidewall adjacent to the fixing element of the pivoting member toward the slider plate, and is blocked by the fixing element of the pivoting member.

When the easy-mount in-ceiling speaker mount is mounted upwardly through an opening of a ceiling, the ceiling support of the slider plate first holds a bottom of the ceiling. Meanwhile, the base frame of each fastening unit is pushed upwardly relative to the sliding slot of the slider plate, and the pivoting member is pressed and pivoted downwardly by the tag of the slider plate while the fixing element of the pivoting member is pivoted upwardly. When the rear flange of the spring holder is no longer blocked by the fixing element, the spring holder is pivoted by the preset torque of the torsion spring to abut against and hold a top of the ceiling in completion of the mounting of the in-ceiling speaker. The mounting procedures of the speaker mount can be easily achieved by simply pushing it upwardly through a ceiling.

Other objectives, advantages and novel features of the invention will become more apparent from the following detailed description when taken in conjunction with the accompanying drawings.

DETAILED DESCRIPTION OF THE INVENTION

Figure 1:
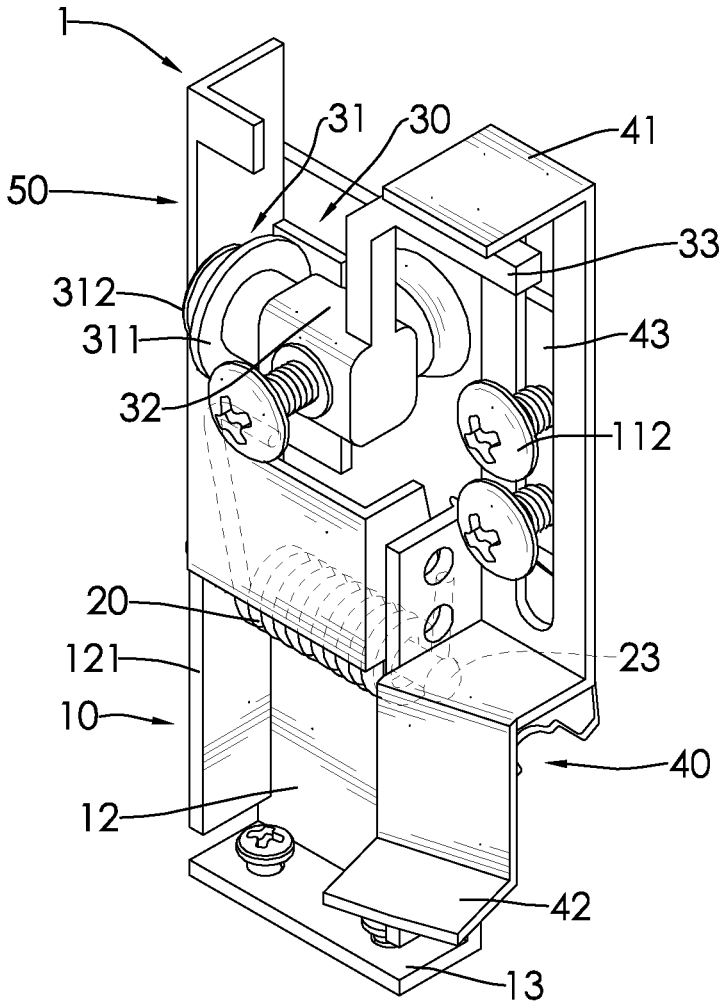
FIG. 1 is a perspective view of an easy-mount in-ceiling speaker mount in accordance with the present invention.
Figure 2:
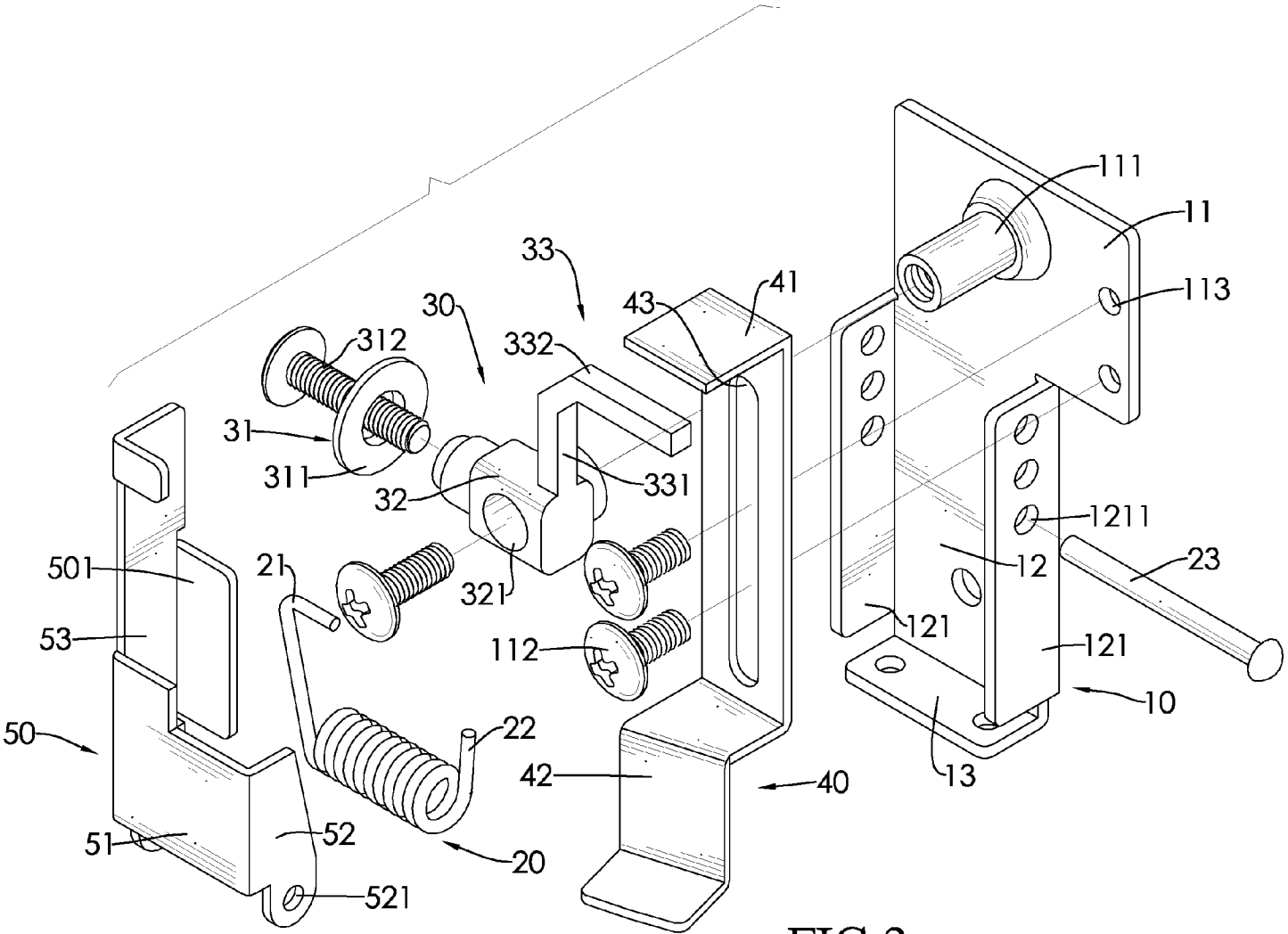
FIG. 2 is an exploded perspective view of the easy-mount in-ceiling speaker mount in FIG. 1.
Figure 3:
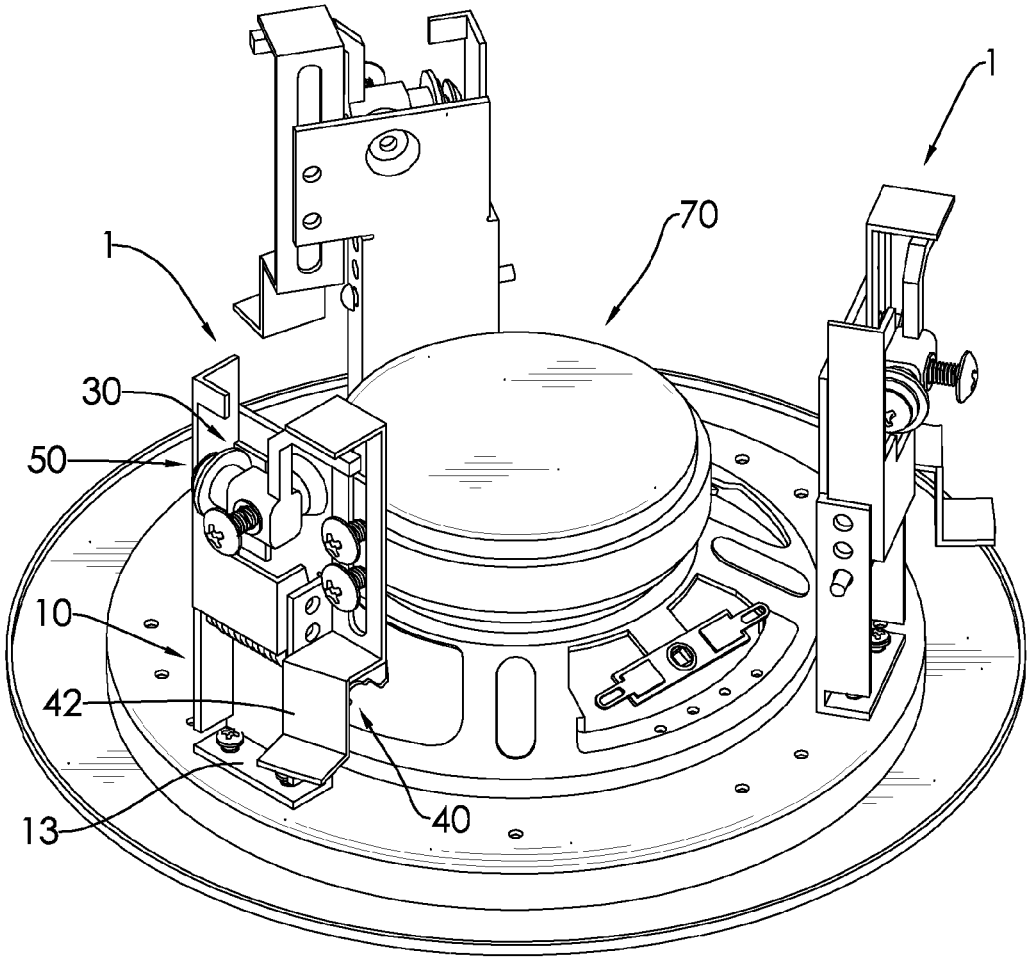
FIG. 3 is a perspective view of multiple easy-mount in ceiling speaker mounts in FIG. 1 mounted on an in-ceiling speaker.

With reference to FIGS. 1 to 3, an easy-mount in-ceiling speaker mount in accordance with the present invention has multiple fastening units 1 mounted on a top of an in-ceiling speaker 70. Each fastening unit 1 has a base frame 10, a torsion spring 20, a pivoting member 30, a slider plate 40 and a spring holder 50.

The base frame 10 has a wide top 11 and a narrow bottom 12. The wide top 11 has a pivot base 111 and two slider guides. The pivot base 111 is formed on and protrudes forwardly from a front of the wide top 11. The slider guides are mounted on a portion of the wide top 11 protruding beyond the narrow bottom 12 in a longitudinal direction. In the present embodiment, each slider guide is composed of a threaded hole and a bolt. The threaded hole is formed in the portion of the wide top 11 protruding beyond the narrow bottom 12. The bolt is screwed into the threaded hole. The narrow bottom 12 has two parallel walls 121 and a mounting seat 13. The parallel walls 121 are formed on and protrude forwardly from two opposite sides of the narrow bottom 12. Each parallel wall 121 has multiple through holes 1211 formed through the parallel wall 121, aligning with each other longitudinally and respectively aligning with the through holes 1211 of the other parallel wall 121. The mounting seat 13 is formed on and protrudes forwardly from a bottom of the narrow bottom 12 and is mounted on an in-ceiling speaker.

The torsion spring 20 is mounted between the parallel walls 121 by mounting a pin 23 through two corresponding through holes 1211 of the parallel walls 121 and the torsion spring 20. The torsion spring 20 has a free end 21 and a fixed end 22. The free end 21 is subjected to a preset torque of the torsion spring 20 rotating the free end 21 clockwise around a direction from the free end 21 to the fixed end. The fixed end 22 abuts against a front of the narrow bottom 12. The torsion spring 20 in FIGS. 1 to 3 is in a state subjected to a preset torque.

The pivoting member 30 has a fixing element 31, a pivot body 32 and a contact rod 33. The fixing element 31 is mounted in one end of the pivot body 32. The pivot body 32 is pivotally mounted on the pivot base 111 of the base frame 10. In the present embodiment, the fixing element 31 has a washer 311 and a bolt 312. The washer 311 is perpendicular to the wide top 11 of the base frame 10, and the bolt 312 is mounted through the washer 311 and screwed into the pivot body 32. The pivot body 32 has a first pivot hole 321 formed through the pivot body 32 for the pivot base 111 to be rotatably mounted through. The contact rod 33 has a vertical segment 331 and a horizontal segment 332. The vertical segment 331 is formed on and protrudes vertically from a top of the pivot body 32. The horizontal segment 332 is formed on and protrudes transversely from a top of the vertical segment 331 and is adjacent to the portion of the wide top 11 protruding beyond the narrow bottom 12.

The slider plate 40 has a sliding slot 43, a tag 41 and a ceiling support 42. The sliding slot 43 is longitudinally formed through the slider plate 40 for the slider guides to be mounted within the sliding slot 43 and longitudinally movable relative to the sliding slot 43. The tag 41 is formed on and protrudes from a top of the slider plate 40 toward the pivoting member 30, and is located above the contact rod 33 of the pivoting member 30. The ceiling support 42 is formed on and protrudes forwardly from a bottom of the slider plate 40. In the present embodiment, the two bolts 112 are respectively mounted in the threaded holes on the wide top 11 of the base frame 10 through the sliding slot 43 so that the slider plate 40 can be slidably moved up and down along the sliding slot 43. Furthermore, the ceiling support 42 is ladder-shaped.

The spring holder 50 is pivotally mounted between the parallel walls 121 of the base frame 10 by penetrating the pin 23 through a bottom of the spring holder 50 and the torsion spring 20, and has a front wall 51, two sidewalls 52, 53 and a rear flange 501. The front wall 51 abuts against the free end 21 of the torsion spring 20 subjected to a preset torque. The two sidewalls 52, 53 are respectively formed on two opposite sides of the front wall 51, and each sidewall 52, 53 has a second pivot hole 521 formed through a lower end of the sidewall 52, 53 to align with the second pivot hole 521 of the other sidewall 53, 52 for the pin 23 to be mounted through. The rear flange 501 is formed on and protrudes transversely from a rear edge of the sidewall 53 adjacent to the fixing element 31 of the pivoting member 30 toward the slider plate 40, and is blocked by the fixing element 31 of the pivoting member 30. The torsion spring 20 is mounted inside the spring holder 50 and between the two parallel walls 121 of the base frame 10 by inserting the pin 23 through the corresponding through holes 1211 on the parallel walls 121 and the second pivot holes 521 on the sidewalls 52, 53 of the spring holder 50 and the torsion spring 20. Two of the through holes 1211 aligning with each other on the parallel walls 121 of the base frame 10 are selectively mounted through by the pin 23 based on a mounting height where the torsion spring 20 and the spring holder 50 are mounted between the parallel walls 121 of the base frame 10.

Figure 4A:
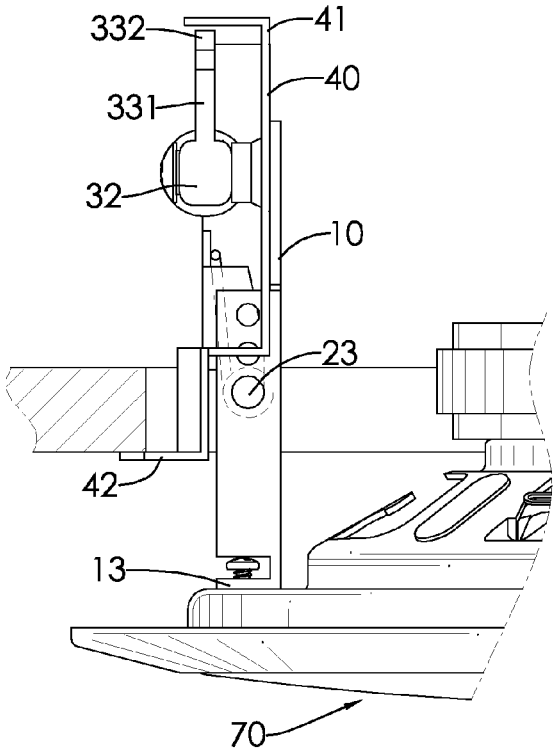
FIG. 4A is an operational side view in partial section of the easy-mount in-ceiling speaker mount in FIG. 1.
Figure 4B:
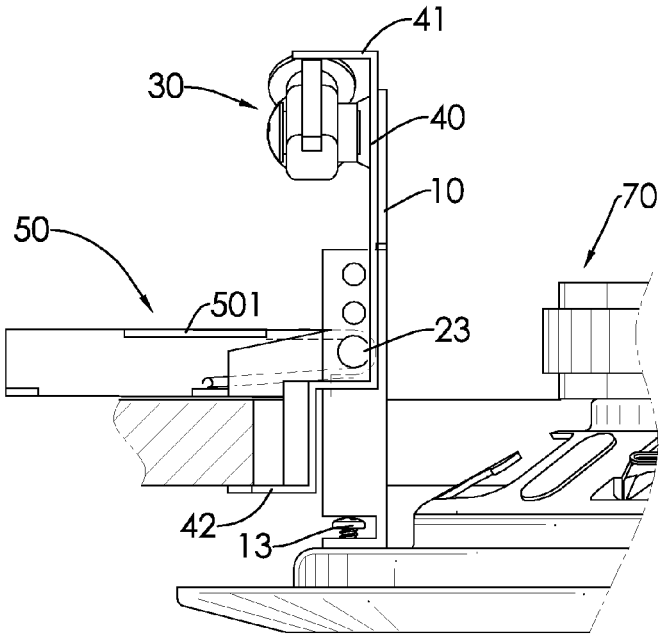
FIG. 4B is another operational side view in partial section of the easy-mount in-ceiling speaker mount in FIG. 1.
Figure 5A:
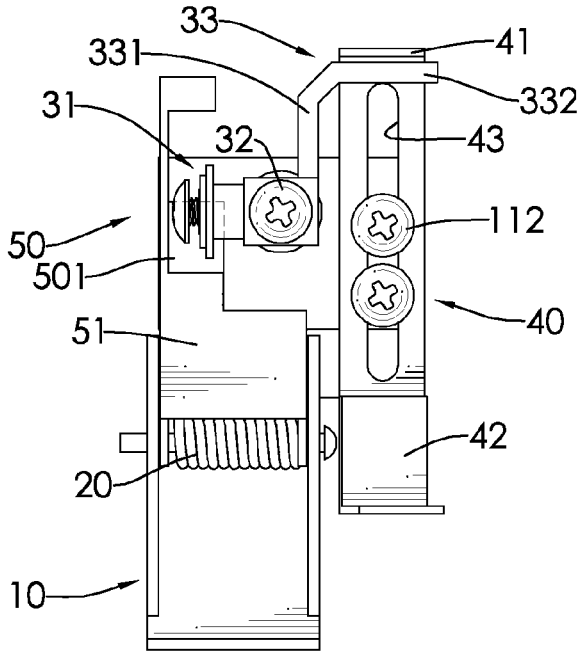
FIG. 5A is an operational front view of the easy-mount in-ceiling speaker mount in FIG. 1.
Figure 5B:
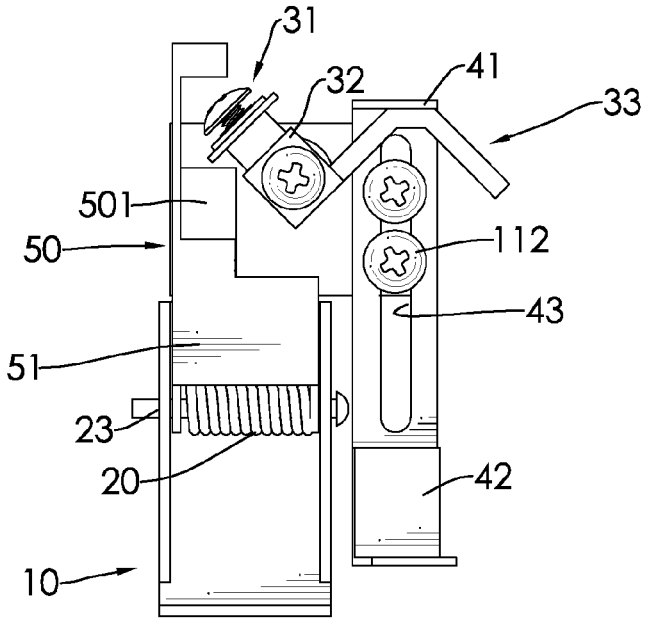
FIG. 5B is another operational front view of the easy-mount in-ceiling speaker mount in FIG. 1.
Figure 6:
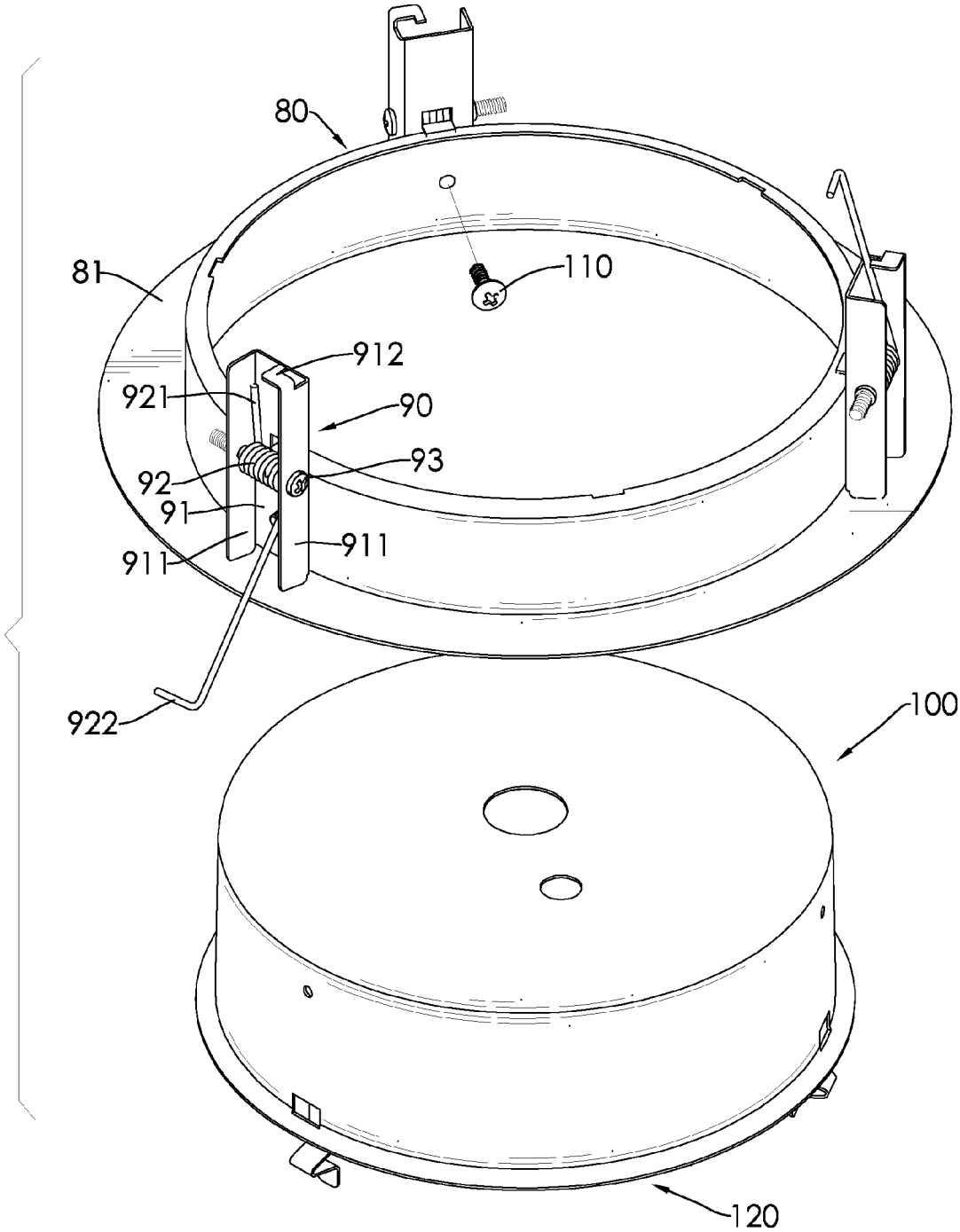
FIG. 6 PRIOR ART
FIG. 6 is an exploded perspective view of a conventional in-ceiling speaker mount.

With reference to FIGS. 4A and 5A, when the easy-mount in-ceiling speaker mount is mounted on an in-ceiling speaker and pushed upwardly through a mounting hole of a ceiling together with the in-ceiling speaker 70, the ceiling support 42 of the slider plate 40 of each speaker mount first holds a bottom of the ceiling. With reference to FIGS. 4B and 5B, when the speaker mount and the speaker 70 are further pushed upwardly, the base frame 10 of each fastening unit is moved upwardly relative to the sliding slot 43 of the slider plate 40, the contact rod 33 of the pivoting member 30 is pressed and pivoted downwardly by the tag 41 of the slider plate 40 while the fixing element 31 of the pivoting member 30 is pivoted upwardly. When the rear flange 501 of the spring holder 50 is no longer blocked by the fixing element 31, the spring holder 50 is pivoted by the preset torque of the torsion spring 20 to abut against and hold a top of the ceiling in completion of the mounting of the in-ceiling speaker 70.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An easy-mount in-ceiling speaker mount having multiple fastening units adapted to be mounted on a top of an in-ceiling speaker, wherein each fastening unit has:

a base frame having:

a narrow bottom having two parallel walls respectively formed on and protruding forwardly from two opposite sides of the narrow bottom, wherein each parallel wall has multiple through holes formed through the parallel wall in a longitudinal direction and respectively aligning with the through holes of the other parallel wall; and a wide top having:

a pivot base formed on and protruding forwardly from the front of the wide top; and two slider guides mounted on a portion of the wide top protruding beyond the narrow bottom in the longitudinal direction;

a torsion spring securely mounted between the parallel walls by selectively mounting a pin through two corresponding through holes of the parallel walls and the torsion spring, and having:

a free end; and a fixed end abutting against a front of the narrow bottom;

a pivoting member having:

a pivot body pivotally mounted on the pivot base of the base frame and having two ends opposite to each other;

a fixing element mounted in one of the ends of the pivot body; and a contact rod mounted on the other end of the pivot body;

a slider plate having:

a sliding slot longitudinally formed through the slider plate for the slider guides to be mounted within the sliding slot and longitudinally movable relative to the sliding slot;

a tag formed on and protruding from a top of the slider plate toward the pivoting member, and located above the contact rod of the pivoting member; and a ceiling support formed on and protruding forwardly from a bottom of the slider plate; and a spring holder pivotally mounted between the parallel walls of the base frame by penetrating the pin through a bottom of the spring holder and the torsion spring, and having:

a front wall abutting against the free end of the torsion spring subjected to a preset torque; and a rear flange formed on and protruding transversely from a rear edge of the sidewall adjacent to the fixing element of the pivoting member toward the slider plate, and blocked by the fixing element of the pivoting member.

2. The easy-mount in-ceiling speaker mount as claimed in claim 1, wherein each slider guide has:

a threaded hole formed in the portion of the wide top protruding beyond the narrow bottom; and a bolt screwed into the threaded hole; and the ceiling support of the slider plate of each fastening unit is ladder-shaped.

3. The easy-mount in-ceiling speaker mount as claimed in claim 1, wherein the fixing element of the pivoting member of each fastening unit has:

a washer being perpendicular to the wide top of the base frame; and a bolt mounted through the washer and screwed into the pivot body of the pivoting member.

4. The easy-mount in-ceiling speaker mount as claimed in claim 2, wherein the fixing element of the pivoting member of each fastening unit has:

a washer being perpendicular to the wide top of the base frame; and a bolt mounted through the washer and screwed into the pivot body of the pivoting member.

* * * * *